US011505991B2

(12) United States Patent
Okachi et al.

(10) Patent No.: US 11,505,991 B2
(45) Date of Patent: Nov. 22, 2022

(54) SCREEN DEVICE

(71) Applicant: METACO INC., Tokyo (JP)

(72) Inventors: Yasubumi Okachi, Kanagawa (JP); Hiroaki Ishii, Kanagawa (JP)

(73) Assignee: METACO INC., Tokyo (JP)

( * ) Notice: Subject to any disclaimer, the term of this patent is extended or adjusted under 35 U.S.C. 154(b) by 0 days.

(21) Appl. No.: 17/211,070

(22) Filed: Mar. 24, 2021

(65) Prior Publication Data

US 2022/0307320 A1 Sep. 29, 2022

(51) Int. Cl.
*E06B 9/54* (2006.01)
*E06B 9/58* (2006.01)

(52) U.S. Cl.
CPC ..... *E06B 9/54* (2013.01); *E06B 9/58* (2013.01); *E06B 2009/543* (2013.01); *E06B 2009/587* (2013.01)

(58) Field of Classification Search
CPC ..... E06B 9/58; E06B 9/582; E06B 2009/587; E06B 2009/543; E06B 2009/588
See application file for complete search history.

(56) References Cited

U.S. PATENT DOCUMENTS 4,467,853 A * 8/1984 Downey, Jr. ..... E06B 9/581 160/133
4,934,437 A * 6/1990 Kraeutler ..... E06B 9/0692 160/264
5,246,053 A * 9/1993 Kraeutler ..... E06B 9/262 160/264
6,082,432 A * 7/2000 Kissinger ..... E06B 9/54 160/28
6,152,208 A * 11/2000 Kalempa ..... E06B 9/582 49/477.1
6,186,212 B1 * 2/2001 Tsuchida ..... E06B 9/54 160/84.06
6,318,438 B1 * 11/2001 Uno ..... E06B 9/58 160/31
6,629,555 B2 * 10/2003 DeBlock ..... E06B 9/54 160/31
6,978,820 B2 * 12/2005 Aoki ..... E06B 9/52 160/84.06
7,025,105 B2 * 4/2006 Lancina ..... E06B 9/17076 160/41
7,395,850 B2 * 7/2008 Chino ..... E06B 9/54 160/243
7,472,738 B2 * 1/2009 Kamosawa ..... E06B 9/522 160/31
7,669,632 B2 * 3/2010 Moriya ..... E06B 9/54 160/31

(Continued)

FOREIGN PATENT DOCUMENTS

EP 2 333 229 6/2011

*Primary Examiner* — Johnnie A. Shablack
(74) *Attorney, Agent, or Firm* — Wenderoth, Lind & Ponack, L.L.P.

(57) ABSTRACT

A screen device includes a screen retaining member defined by needle-shaped parts attached, in intervals, to a longitudinal base part which is bendable in a pivotally movable direction of each of plural guide units. In an attached condition of the screen retaining member, the longitudinal base part is supported between a rail part and a supporting piece of each of the guide units and all of the needle-shaped parts protrude inwardly between opposing side walls of each of the guide units.

2 Claims, 6 Drawing Sheets

(56) References Cited

U.S. PATENT DOCUMENTS 7,694,711 B2 * 4/2010 Okachi ..... E06B 9/58 160/245
7,717,152 B2 * 5/2010 Moriya ..... E06B 9/54 160/31
7,726,377 B2 * 6/2010 Okachi ..... E06B 9/262 160/84.06
7,810,543 B2 * 10/2010 Donatelli ..... E06B 9/54 160/31
7,829,174 B2 * 11/2010 Kanzaki ..... B32B 27/12 49/495.1
7,931,070 B2 * 4/2011 Chino ..... E06B 9/52 160/84.06
7,963,312 B2 * 6/2011 Okachi ..... E06B 9/262 160/31
7,984,744 B2 * 7/2011 Karasawa ..... E06B 9/522 160/84.06
8,082,969 B2 * 12/2011 Okachi ..... E06B 9/262 160/84.06
8,191,601 B2 * 6/2012 Okachi ..... E06B 9/54 160/31
8,196,638 B2 * 6/2012 Roberts ..... E06B 9/54 160/84.06
8,316,912 B2 * 11/2012 Okachi ..... E06B 9/52 160/84.06
8,925,614 B2 * 1/2015 Okachi ..... E06B 9/54 160/31
9,004,138 B2 * 4/2015 Okachi ..... E06B 9/54 160/31
9,487,986 B2 * 11/2016 Okachi ..... E06B 9/54
10,041,294 B2 * 8/2018 Van Loosbroek ..... E06B 9/522
10,822,868 B2 * 11/2020 Okachi ..... E06B 9/322
10,920,488 B2 * 2/2021 Toda ..... E06B 9/54
2011/0203752 A1 * 8/2011 Okachi ..... E06B 9/54 160/372
2013/0306252 A1 * 11/2013 Lambridis ..... E06B 9/582 160/133
2015/0204137 A1 * 7/2015 Montanaro ..... E06B 9/56 160/84.02
2018/0305976 A1 * 10/2018 Okachi ..... E06B 9/0692
2019/0048659 A1 * 2/2019 Toda ..... E06B 9/54
2021/0396073 A1 * 12/2021 Lai ..... E06B 9/582

* cited by examiner

SCREEN DEVICE

TECHNICAL FIELD

The invention relates to a screen device adaptable to a blinding or dimming member such as a net door or a partition as well as a curtain or a blind.

BACKGROUND ART

Conventionally, this kind of the screen device is generally provided with an expandable and storable screen, on a premise that an expanding and storing direction of the screen is an X-axis direction in orthogonal three axes, i.e., the X-axis, a Y-axis and a Z-axis, a pair of frames arranged opposite to each other, of which at least one is a slidable frame in the X-axis direction, and which consist of a first frame which is longitudinal in the Z-axis and hollow and to which one end of the screen in the X-axis direction is fixed and a second frame to which the other end of the screen in the X-axis direction is fixed, first and second guides which are brought out of an inner space of the slidable frame in the other side of the X-axis direction when the slidable frame slides to one side of the X-axis and are stored in the slidable frame when the slidable frame slides in the other side of the X-axis direction, and of which brought-out portions maintains linearly in the X-axis direction between one and the other ends in the Z-axis direction of the pair of the frames, respectively, and a tension member connecting free ends of the first and second guides, which is arranged in the inner space of the slidable frame.

EP 2333229 A2 discloses a screen device in which the first guide is formed by connection of a plurality of the first guide units and each of the first guide units is provided with a pair of side walls arranged opposite to each other in the Y-axis direction when the first guide is brought out of the inner space of the slidable frame. In the first guide, among two adjacent first guide units, one first guide unit is pivoted on the other first guide unit. The first guide maintains linearity in the X-axis direction and is also bendable in the Z-axis direction by pivoting so that one end in the Z-axis direction of the expanded screen is inserted between the opposing side walls of the each of the first guide units at the brought-out portion of the first guide from the slidable frame.

Further, in the above-identified screen device, a pair of pins protrude outwardly from the opposing side walls at one end part in the X-axis direction of a part of the side walls of each of the first slide guide units. Said one end part extends in the X-axis direction of the side walls. A pair of openings are formed at the other end part in the X-axis direction of the side walls of each of the slide guide units. The adjacent two first guide units are connected by loosely fitting each of the pins of one first guide unit to a corresponding opening of the other first guide unit and the pins forms pivots.

Furthermore, a pair of rigid protrusions directing an inner side between the opposing side walls of the first guide units are arranged at the same side parts of the side walls of the first guide units. The rigid protrusions extend along a virtual line in a plane including the virtual line virtually connecting centers of the pivots of the first guide units. The rigid protrusions stick one end part in the Z-axis direction of the screen inserted between side walls of each of the first guide units at the brought-out portions of the first guide when the first guide is brought out in the other side of the X-axis direction according to a sliding movement of the slidable frame in one side of the X-axis direction. Thus, the rigid protrusions hold one end part in the Z-axis direction of the screen so as not to slip out of the brought-out portions of the first guide when external forces such as a wind pressure are applied to the screen.

However, since each of the guide units is generally an integral molded resin article, and sticking and slip-out of the protrusions is repeated by expansion and storage of the screen, there is a problem that the rigid protrusions are liable to transform by bending and partial breakages. Additionally, the screen is made of several materials under consideration of usage of installation location of the screen device. Accordingly, in the case where strength of a molding material of each of the first guide units is higher than that of the screen, one end part of the Z-axis direction of the screen is probably damaged. In order to suppress such a damage of the screen, it is necessary for the screen device above-identified to prepare a plurality of the first guide units by selecting a material correspond to a material of the screen from a plurality of materials. As a result, the plural first guide units made of different materials are necessary and it is not possible to make the slide guide in only one kind of material.

SUMMARY OF INVENTION

Technical Problem

In the light of the problems above-mentioned, the invention provides a screen device which suppresses breakages of one end part of the Z-axis direction of the screen which is inserted between the opposing side walls of the first guide even by repetition of expansion and storage of the screen and is able to be assembled with the first slide guide formed by only one kind of first slide guide units.

Solution to Problem

To solve the problems above-mentioned, one of the aspects of the invention provides a screen device SD, comprising,

- an expandable and storable screen 1, on a premise that an expanding and storing direction of the screen 1 is an X-axis direction in orthogonal three axis system that include the X-axis, a Y-axis and a Z-axis,
- a pair of frames arranged opposite to each other, of which at least one is a slidable frame in the X-axis direction, and which consist of a first frame 2 which is longitudinal in the Z-axis direction and hollow and to which one end of the screen 1 in the X-axis direction is fixed and a second frame 2 to which the other end of the screen 1 in the X-axis direction is fixed,
- first and second guides 6, 7 which are brought out of an inner space of the slidable frame in the other side of the X-axis direction when the slidable frame slides to one side of the X-axis direction and are stored in the slidable frame when the slidable frame slides in the other side of the X-axis direction, and of which brought-out portions 62, 72 from the inner space of the slidable frame maintains linearly in the X-axis direction between one and the other ends in the Z-axis direction of the pair of the frames, respectively, and
- a tension member 8 connecting free ends 61, 71 of the first and second guides 6, 7, which is arranged in the inner space of the slidable frame,
- wherein the first guide 6 is formed by connection of a plurality of the first guide units 63 each of which is provided with a pair of side walls 63*a*, 63*a* arranged opposite to each other in the Y-axis direction when the first guide 6 is brought out of the inner space of the slidable frame, and a bottom wall 63*b* connects the side walls 63*a*, 63*a*, wherein in the first guide 6, among the adjacent two first guide units 63, one first guide 63 is pivoted on the other first guide units 63, and the first guide 6 maintains linearity in the X-axis direction and bends in the other side of the Z-axis direction by pivoting, and wherein one end part of the screen 1 in the Z-axis direction is inserted between the opposing side walls 63*a*, 63*a* of each of the first guide unit 63 at a brought-out portion 62 from the inner space of the slidable frame, characterized in that:

a pair of pins 63*c* protrude outwardly from the opposing side walls 63*a*, 63*a* at one end part in the X-axis direction of the side walls 63*a*, 63*a* and a pair of openings 63*d* are formed at the other end part in the X-axis direction of the side walls 63*a*, 63*a* of each of the side guide units 63, among two adjacent first guide units 63, to each of the openings 63*d* of one first guide unit 63, each of pins 63*c* of the other first guide unit 63 is loosely fitted so that the two adjacent two slide guide units 63 are connected, and the pins 63*c* forms pivots, a rail part 63*g* is arranged at an inner-side part of the opposing side walls 63*a*, 63*a*, the rail part 63*g* extends along a virtual line VL in a plane including the virtual line VL which is virtually formed by connecting centers of the pivots of the first guide units 63 in a connection direction of the first guide units 63, and a supporting piece 63*h* protrudes inwardly between the opposing side walls 63*a*, 63*a* at an end edge part of each of the side walls 63*a*, 63*a*, the end edge part positioned further apart from the bottom wall 63*b* in the other side of the Z-axis direction than a position of the rail part 63*g*, a screen retaining member 9 is formed by detachably attaching a plurality of needle-like parts 92 in intervals to a longitudinal base part 91 which is bendable in a pivotally moving direction of each of the first guide units 63, and in an attached condition of the screen retaining member 9, the base part 91 is supported between the rail part 63*g* and the supporting piece 63*h* of each of the first guide units 63 and all of the needle-like parts 92 protrude inwardly between opposing side walls 63*a*, 63*a* of each of the first guide unis 63, and when the first guide 6 is brought out in the other side of the X-axis direction according to a sliding movement of the slidable frame in one side of the X-axis direction, the needle-like parts 92 of each of the screen retaining members 9 stick one end part in the Z-axis direction of the screen 1 which is inserted between the side walls 63*a*, 63*a* of each of the first guide units 63 so that the screen 1 is disable to slip out of the brought-out portion 62 of the first guide 6 and, on the other hand, when the first guide 6 is stored in the slidable frame according to a sliding movement in the other side of X-axis direction of the slidable frame, the needle-like parts 92 of each of the screen retaining members 9 slip out of the one end part in the Z-axis direction of the screen 1.

According to one aspect above-identified, plural kinds of the screen retaining members which a plurality of needle-like parts of which a material corresponds to that of the screen are attached to the base part are prepared in advance. A screen retaining member appropriately selected is able to be attached to an inner-side part of slide walls of each of the first guide units. One end of the screen in the Z-axis direction, which is inserted between the slide walls of each of the first guide units, is prevented from being damaged even by repetition of expansion and storage of the screen. Additionally, it is unnecessary to make plural kinds of the first guide units corresponding to the material of the screen and therefore the first guide is formed with only one kind of first guide units.

The other aspect of the invention provides the screen device SD with the one aspect above-identified, additionally, wherein a concavity 63*j* extends in a same direction as an extending direction along the X-axis of the brought-out portion 62 of the first guide 6 from the slidable frame and is detented inwardly between the opposing side walls 63*a*, 63*a*, a curved projection 11 with a prescribed curvature is arranged at a pair of opposing inner-side faces in the Y-axis direction of one end part in the Z-axis direction of the slidable frame, and each of the curved projection 11 is inserted into the concavity 63*j* of each of the first guide units 63 so that storage and brought-out of the first guide 6 in and from the slidable frame are guided by the curved projection 11.

According to the other aspect above-identified, the first guide is able to be smoothly bended and directs to the other side of the Z-axis direction in the slidable frame. The first guide is also able direct toward the other side of the X-axis direction of the slidable frame and is also put back into an original place. Accordingly, smooth storage and brought-out of the first guide in and out of the slidable frame is achieved.

BRIEF DESCRIPTION OF THE DRAWINGS

FIG. 3B is bent.

DESCRIPTION OF EMBODIMENTS

Figure 1:
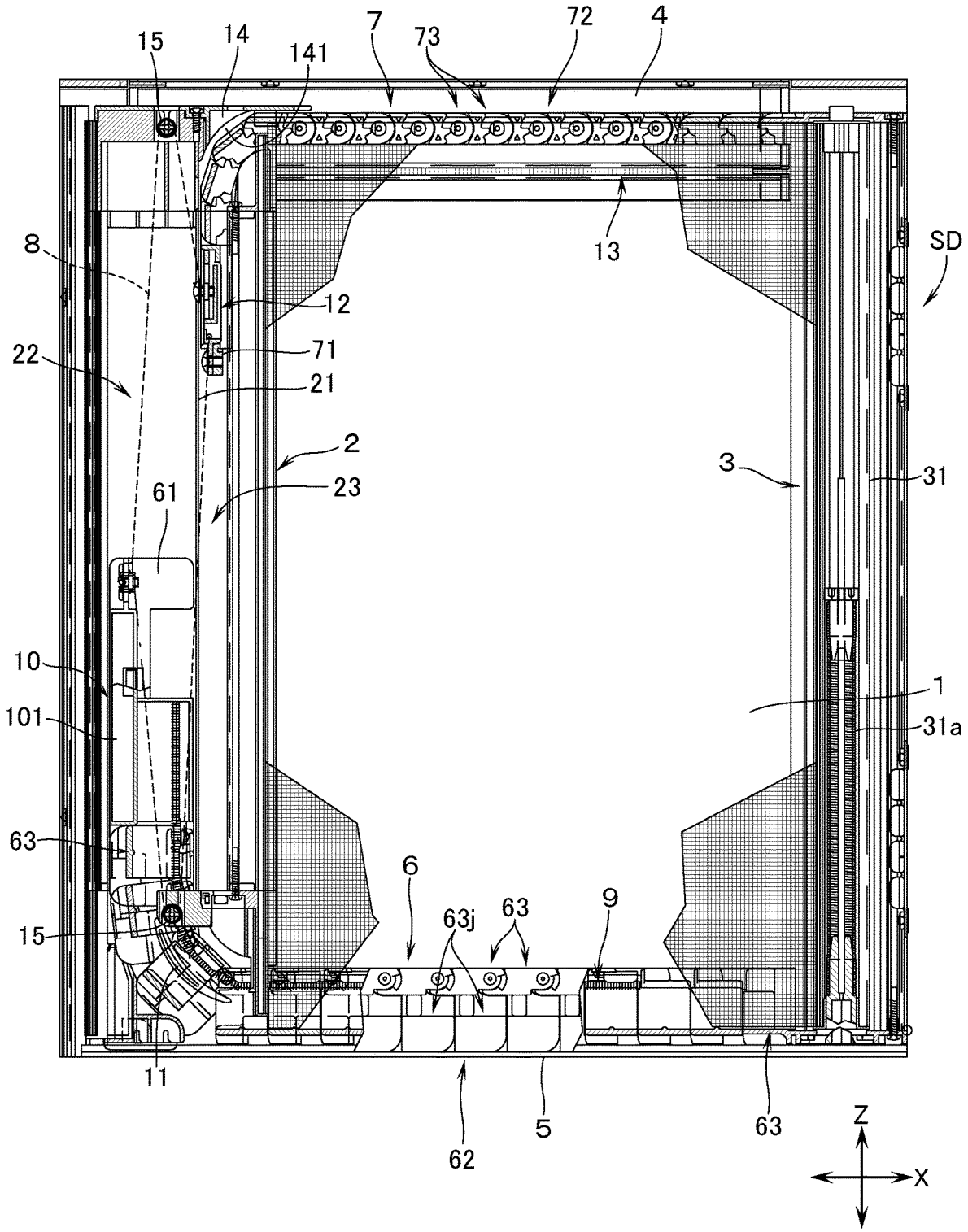
FIG. 1 is a partially notched cross section of an embodiment of the screen device of the invention.

Referring to FIG. 1, a screen device SD of an embodiment is provided with an expandable and storable screen 1. The screen device SD is installed in an opening such as in a window frame or a door frame. The screen 1 opens and closes the opening. In the screen device SD, on a premise that an expanding and storing direction of the screen 1 is an X-axis direction in orthogonal three axes system, i.e., a system comprising the X-axis, a Y-axis and a Z-axis, wherein the X-axis direction corresponds to a horizontal direction (a right and left-side direction of FIG. 1), and the Z-axis direction corresponds to a vertical direction (a perpendicular direction of FIG. 1). Accordingly, in explanations below, one side of the X-axis direction is a left side and the other side of the X-axis direction is a right side, and one side of the Z-axis direction is an upper side and the other side of the Z-axis direction is a lower side.

The screen device SD is provided with a first frame 2 which is slidable in the right-and-left side direction in the opening above-identified and is hollow and a second frame 3 which is opposed to the first frame 1 in the right-and-left side direction, and is longitudinal in the perpendicular direction and hollow. The second frame 3 is fixed to a right-side end of the opening above-identified. The first and second frames 2 and 3 consist of a pair of frames. A left-side end of the screen 1 is fixed to the first frame 2 and a right-side end of the screen 1 is fixed to the second frame 3. Specifically, a left-side end of the screen 1 is fixed to a right-side end part of the first frame 1 and a right-side end of the screen 1 is fitted to a part in the perpendicular direction of a periphery part of a roller pie 31. The roller pipe 31 is longitudinal in the perpendicular direction, hollow, and rotatably stored in the second frame 3. When a user of the screen device 1 performs an opening operation in which the user slides the first frame 2 in the left-side direction, the screen 1 wounded around a periphery surface of the roller pipe 31 is rolled out and expanded in the opening above-identified. On the other hand, when the user stops the opening operation, the screen 1 is wound around the periphery surface of the roller pipe 31 and is stored in the second frame 3. At this time, the first frame 2 automatically slides in a right-side direction and when a right-side end of the first frame 2 comes into contact with a left-side end of the second frame 3, a sliding movement of the first frame 2 is automatically stopped.

In order to achieve said automatic storage of the screen 1 in the second frame 3, a coil spring 31*a* is built in the roller pipe 31*a*. When the coil spring 31*a* is twisted, an elastic force is generated. The elastic force is accumulated with a continuous rotation of the roller pipe 31 in the second frame 3 according to the sliding movement of the first frame 2 in the left-side direction. When the user stops the opening operation, the accumulated elastic force is released, the roller pipe 31*a* reverses in the second frame 3 and the screen 1 is wound around the peripheral surface of the roller pipe 31.

Additionally, in the screen device SD, an upper rail 4 is provided at an upper part of the opening above-identified and a lower rail 5 is provided at a lower-side end for a smooth sliding movement of the first frame 2 in the right-and-left side direction. The upper rail 4 is a hollow member of which a section in the perpendicular direction is U-shaped. An upper-side end part of the first frame 2 is inserted into the upper rail 4. The lower rail 5 is a linear and longitudinal member in the right and left-side direction. Some wheels, omitted in FIG. 1, are mounted at a lower part of the first frame 2 and the wheels rotates on the lower rail 5. Thus, a sliding movement of the first frame 2 in the right and left-side direction is smoothly achieved thanks to the upper and lower rails 4 and 5.

The screen device SD is also provided with a first guide 6 and a second guide 7. The first and second guides 6 and 7 are brought out of an inner space of the first frame 2 when the first frame 2 slides in the left-side direction and are stored in the first frame 2 when the first frame 2 slides in the right-side direction. Each of the first and second guides 6 and 7 has a free end 61, 71. Brought-out portions 62, 72 from the inner space of the first frame 2 maintain linearity in the right-and-left direction and the brought-out portions 62, 72 linearly extend not only between the lower parts of the first and second frames 2 and 3 consisting the pair of frames but also between the upper parts of the first and second frames 2 and 3. The screen device SD is also provided with a tension member 8 connecting free ends 61, 71 of the first and second guides 6 and 7. The tension member 8 is arranged at the inner space of the first frame 2. The tension member 8 forms preferably an uncrossed loop but, in a different embodiment the tension member 8 may form a crossed loop. A shape of the tension member 8 is not specifically limited as far as the tension member 8 is able to connect free ends 61, 71 of the first and second guides 6 and 7. For example, the tension member 8 may not form a loop.

Referring to FIG. 2, FIG. 3A, FIG. 3B, FIG. 4A, FIG. 4B, FIG. 4C, and FIG. 4, the first guide 6 is formed by connecting a plurality of first guide units 63. Each of the first guide units 63 is provided with a pair of side walls 63*a* opposite to each other in the Y-axis direction shown in FIG. 2, a bottom wall 63*b* connecting the side walls 63*a*, 63*a*. In the first guide 6, among the two adjacent first guide units 63, 63, one first guide unit 63 is pivoted on the other first guide unit 63. By pivoting, the first guide 6 is able to upwardly bend as well i maintains linearity in the right-and-left direction. A pair of pins 63*c*, 63*c* outwardly protruding between the opposing side walls 63*a*, 63*a* are arranged at an upper-and-left side end part of the side walls 63, 63 of each of the first guide units 63. The upper-and-left side end part of the side walls 63, 63 correspond to an upper-end part of the brought-out portion of the first guide 6 from the first frame 2. A pair of openings 63*d*, 63*d* are formed at upper-and-right side end parts of the side walls 63, 63.

Specifically, a first recessed part $63a_1$ is formed at a peripheral part near the pin 63*c* of each of the side walls 63*a* of each of the first guide unit 63. The first recessed part $63a_1$ is inwardly recessed between the opposing side walls 63*a*, 63*a*. A length of each of the pins 63*c* corresponds to a depth of each of the first recessed parts $63a_1$. Additionally, an outer diameter of each of the pins 63*c* and an inner diameter of each of the openings 63*d* are such a size that the pin 63*c* loosely fits to the opening 63*d*. In each of the side walls 63*a*, 63*a*, a peripheral part near each of the openings 63*d* except the upper-side end part of each of the side walls 63*a*, 63*a* is notched and a first notch $63a_2$ is formed. A protruding piece 63*e* extending in the right-side direction is formed at an edge part of the upper-side end of each of the side walls 63*a*, 63*a*. In each of the first recessed parts $63a_1$, a hill part 63*f* raising upwardly is formed at the right-and-lower side end part. In a part positioned at lower than the first recessed part $63a_1$ at a lower-side end part of each of the side walls 63*a*, 63*a*, the second recessed part $63a_3$ a of which depth is as deep as one of the first recessed part $63a_1$. Besides, the bottom wall 63*b* is arranged at a position corresponding to an upper-side end part of the second recessed part $63a_3$ of each of the side walls 63*a*, 63*a* and has a length extending from a left-side end of the second recessed part $63a_3$ to a lower-and-left side end of the first notch $63a_2$ in each of the first guide units 63.

In the first guide 6, among two adjacent first guide units 63, 63, between the opposing side walls 63*a*, 63*a* of one first guide unit 63, left-side end parts of the side walls 63*a*, 63*a* of the other first guide unit 63 are inserted and each of pins 63*c* of the other first guide unit 63 is loosely fitted to each of the openings 63*d* of one first guide unit 63. At this time, each of the pins 63*c*, 63*c* forms pivots. The first guide 6 is formed by repetition of such a connection as above-mentioned. A pivotally moving range of the two adjacent first guide unit 63 is ranged from a position which right-and-lower side end parts of the side walls 63*a*, 63*a* of one first guide 63 come into contact with the left-and-lower parts of the side walls 63*a*, 63*a* of the other first guide unit 63 to a position each of the protruding pieces 63*e* of the side walls 63*a*, 63*a* of one first guide unit 63 come into contact with each of the hill parts 63*f* of each of the first recessed part 63$a_1$ formed at the side walls 63*a* of the other first guide unit 63. The pivotally moving range of each of the first guide units 63 is the same as that of the first guide units 63. Accordingly, as shown in FIG. 1, the first guide 6 is able to bend so as to direct toward the upper-side end of the first frame 2 at a time when the first guide 6 is stored in the first frame 2 and is able to move in the right-side direction so as to be put back into an original position when the first guide 6 is brought out of the first frame 2.

When the first guide 6 is brought out of the first frame 2, among the two adjacent first guide units 63, 63, each of the second recessed part 63$a_3$ of each of the side walls 63*a*, 63*a* of one first guide unit 63 pivotally moving is inserted between the side walls 63*a*, 63*a* of the other first guide unit 63. Therefore, an outer side surface of the lower-side end part of each of the side walls 63*a*, 63*a* of the first guide unit 63*a* become flushness at the brought-out portion 62 of the first guide 6 from the first frame 2. As above-mentioned, since the length of each of the pins 63*c* corresponds to the depth of the first recessed portion 63, an outer-side faces of the pins 63*c* and outer-side faces of the upper-side end parts of the opposing side walls 63*a*, 63*a* become flushness.

Further, a rail part 63*g* is arranged at an inner-side part of each of the side walls 63*a*, 63*a* of the first guide units 63. Each of the rail parts 63*g* extends along a virtual line VL in a plane including the virtual line VL formed by connecting centers of the pivots above-identified of the first guide units 63 in a connection direction of the first guide units 63. Supporting pieces 63*h* inwardly protrude between the opposing side walls 63*a*, 63*a* at edge parts of the upper-side ends of the side walls 63*a*, 63*a*, respectively. The supporting piece 63*h* is positioned at a more upper-side part than the rail part 63*g* is positioned. Each of the supporting pieces 63*h* is arranged perpendicularly opposite to each of the rail parts 63*g* in each of the side walls 63*a*, 63*a*. A receiving part 63*i* is formed between the supporting piece 63*h* and the rail part 63*g*. See FIG. 4(*d*). Specifically, the rail part 6*g* has a length extending from the left-side end of the first guide unit 63 to the left-and-lower side part of the first notch 63 $a_2$. On the other hand, the supporting piece 63*h* extends in the right-and-left side direction except the left-side part of the first guide unit 63. Further, a front shape of each of the supporting pieces 63*h* is an L-like one and each of the supporting pieces 63*h* consists of a locking part 63$h_1$ hanging down parallel to each of the side walls 63*a*, 63*a* and a slant part 63*h*2 coming near the rail part 63*g* with declivity between the opposing side walls 63*a*, 63*a*.

Figure 5A:
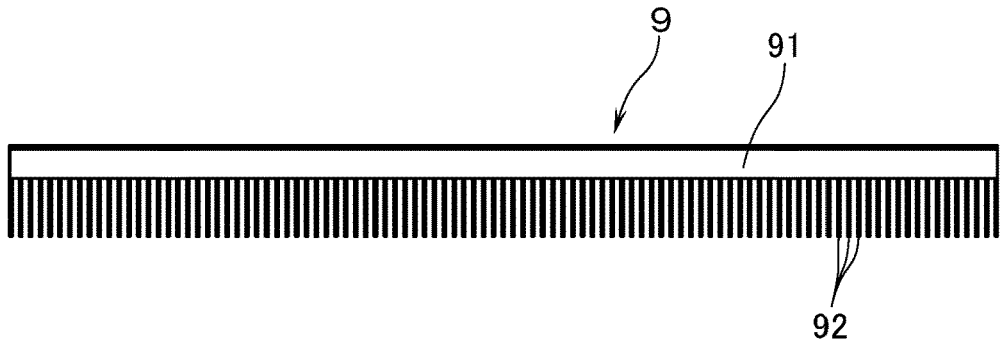
FIG. 5A and FIG. 5B are side and front views of a screen retaining member shown in FIG. 2, FIG. 3A and FIG. 3B, respectively.
Figure 5B:
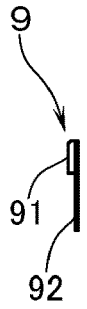

Each of the rail parts 63*g* functions as a guide when a screen retaining member 9 is attached to and detached from the first guide 6. Referring to FIG. 5A and FIG. 5B, the screen retaining member 9 consists of a base part 91 which is bendable in a pivotally moving direction of the first guide units 63 of the first guide 6 and is longitudinal, and a plurality of needle-like parts 92 attached to the base 91 in intervals. The screen retaining member 9 is attached to the inner-side of each of the side walls 63*a*, 63*a* by inserting the base part 91 into the receiving parts 63*i* of the first guide units 63 from one of the left-side and right-side ends of the first guide 6. The rail parts 63*g* guide the insertion of the base part 91 into the receiving parts 63*i* during attachment the screen retaining member 9 to the first guide 6. In an attached condition of the screen retaining member 9, the base part 91 is supported between the rail parts 63*g* and the supporting pieces 63*h* and all of the needle-like parts 92 inwardly protrude between the opposing side walls 63, 63 of the first guide units 63. Additionally, the screen retaining member 9 is detached from the first guide 6 along the rail parts 63*g* by bringing the base part 91 out of an inner space of each of the receiving parts 63*i* of the first guide units 63 from one of the left-side and right-side ends of the first guide 6.

Figure 2:
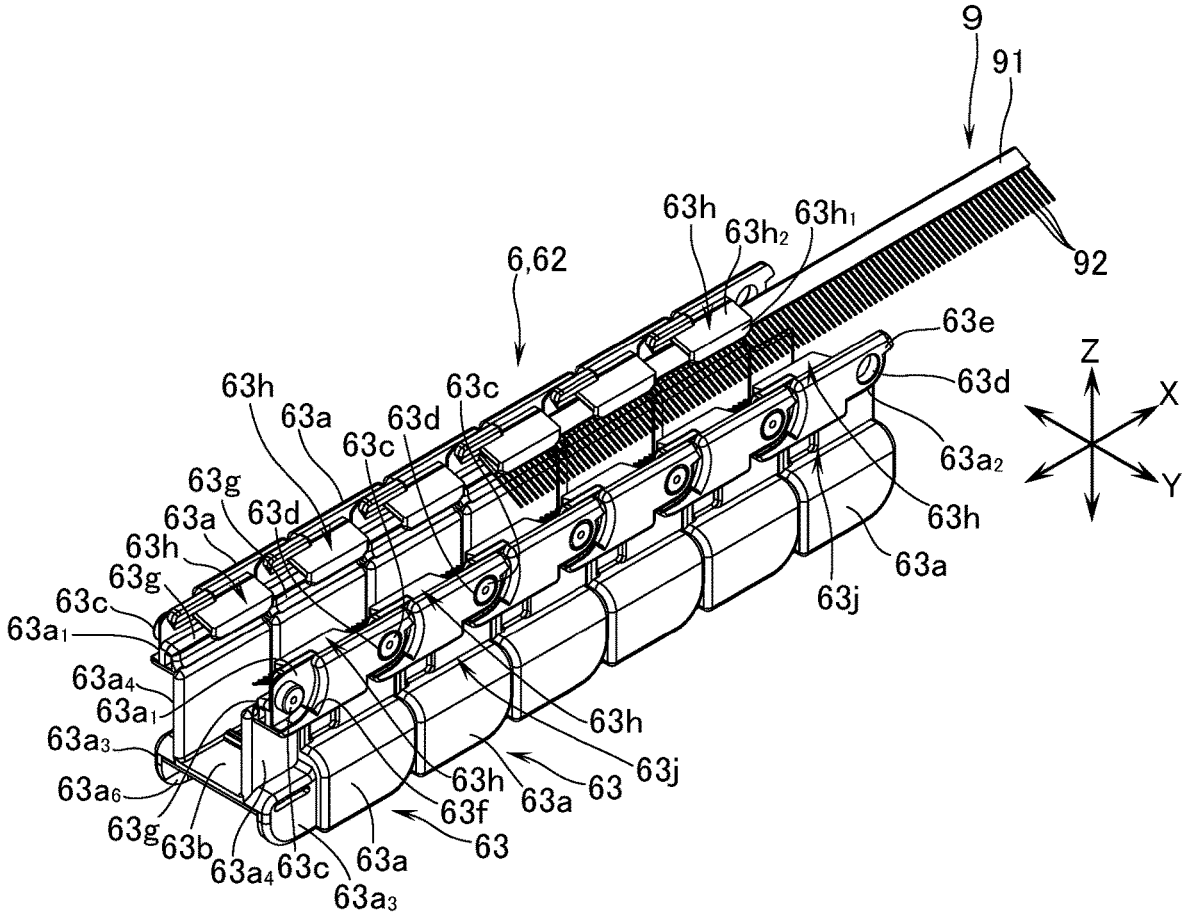
FIG. 2 is a perspective view of main parts of a first guide of the screen devise shown in FIG. 1.

Specifically, the base part 91 is locked by the locking parts 63$h_1$ of the supporting pieces 63*h* of the first guide units 63 and all of the needle-like parts 92 are slanted toward the bottom wall 63*b* along the declivity of the slant parts 63$h_2$. See FIG. 3B. A clearance in the Y-axis direction which is shown in FIG. 2 is formed between tip ends of the needle-like parts 92 in a protrusion direction of two screen retaining members 9 attached to the opposing side walls 63*a*, 63*a*.

Figure 3A:
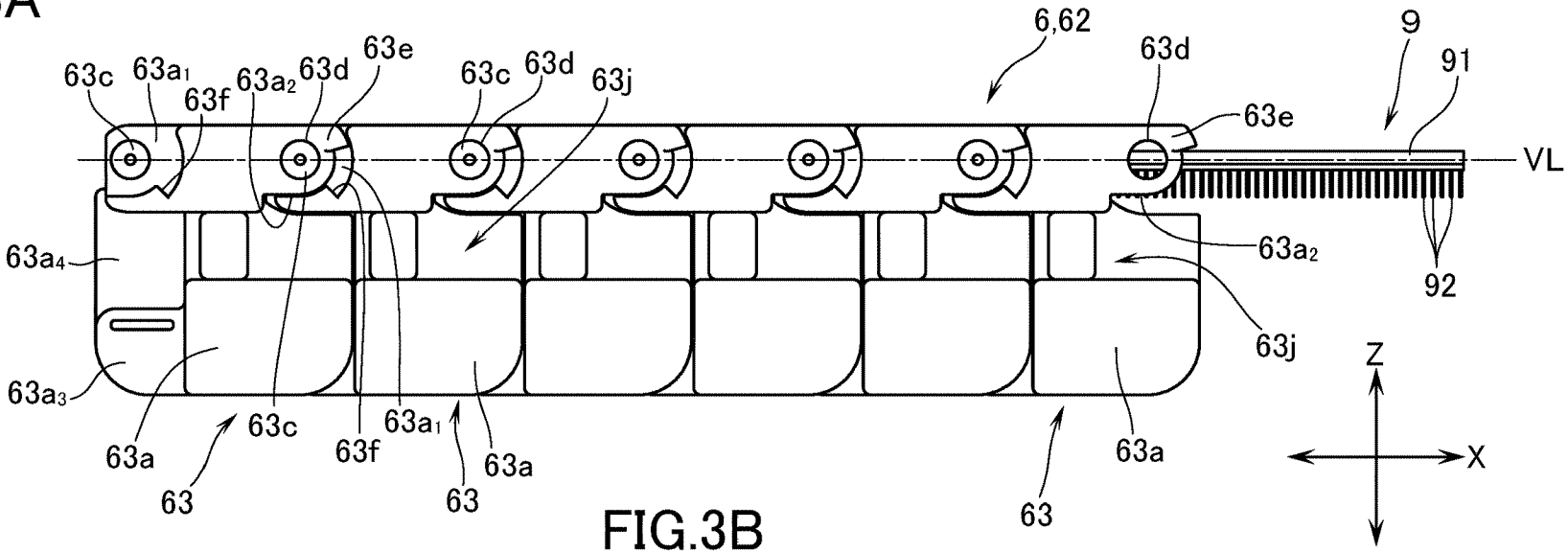
FIG. 3A and FIG. 3B are side and front views of the first guide shown in FIG. 2, respectively.
Figure 6:
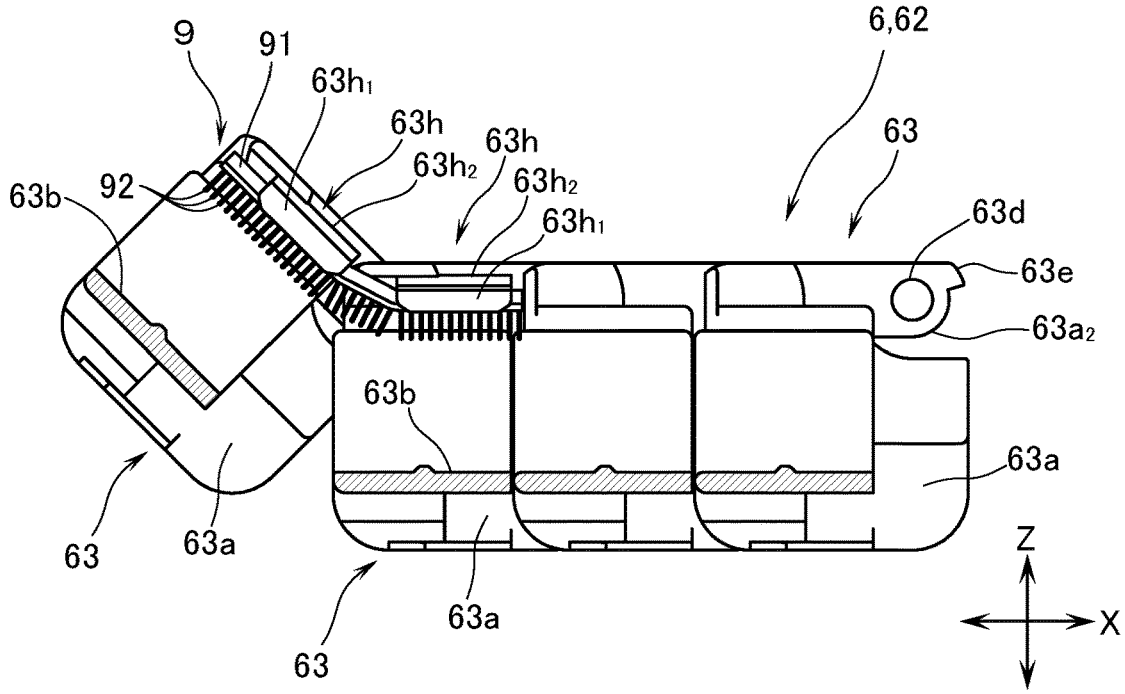
FIG. 6 is a notched side view of main parts of a bended condition of the screen retaining member when the first guide shown in FIG. 2, FIG. 3A

As above-mentioned, since the base part 91 of the screen retaining member 9 is bendable in the pivotally moving direction of each of the first guide units 63 of the first guide 6, when the screen retaining member 91 bends so as to direct toward the upper-side end of the first frame 2 shown in FIG. 1, as shown in FIG. 6, the screen retaining member 9 bends in the same direction as one of the first frame 2. Further, since each of the rail part 63*g* extends along the virtual line VL in the plane including the virtual line VL connecting the centers of the pivots of each of the first guide units 63, as shown in FIG. 3A, the based parts 91 of the screen retaining members 9 is arranged parallel to the virtual line VL above-mentioned. The pivotal movements of the first slide guide units 63, in other word, bending of the first guide 6, is smoothly achieved by such an arrangement as above-mentioned. Additionally, since the above-identified pivots are positioned at the upper-side end part of each of the first guide units 63, the pivots are upwardly positioned apart from a lower-side end of the opening in which the screen device SD is installed. Consequently, any of the pivots is hard to be influenced by dusts, sands and muds collected near the lower-side end of the opening above-identified and the closing operation of the first frame 2 by the user becomes swinging and stable together with the smooth bending of the first guide 6. Similarly, since the base parts 91 of the screen retaining members 9 in the bended condition are easily put back into an original condition, putting back of the first guide 6 into an original place when the first guide 6 is brought out of the first frame 2 is also smoothly attained. Consequently, the opening operation of the first frame 2 is also swinging and stable.

Furthermore, each of the opposing side walls 63*a*, 63*a* of the each of the first guide unit 63 is provided with a concavity 63*j* inwardly detented. The concavity 63*j* extends in the same direction as in one the portion 62 of the first guide 6 which is brought out of the first frame 2 and the concavity 63*j* extends in the right-and-left side direction. A third recessed part 63$a_4$, similar to the first and second receded parts 63$a_1$ and 63$a_2$, inwardly recessed between the opposing side walls 63*a*, 63*a* is formed at the left-side end part of the opposing side walls 63*a*, 63*a*. The third recessed part 63$a_4$ is arranged between the first recessed part 63$a_1$ and the second recessed part 63$a_3$. A second notch 63$a_5$ is formed by being notched the inner-side faces between right-side end parts of the opposing side walls 63*a*, 63*a*. See FIG. 4B and FIG. 4C.

The second notch 63$a_5$ of the first guide unit 63 pivotably moving overlaps the third recessed part 63$a_4$ of the first guide unit 63 having finished pivotably moving of the adjacent first guide unit 63 when the first guide 6 is brought out of the first frame 2 and each of the first guide units 63 pivotably moved. Linearity of the brought-out portion 62 of the first guide 6 from the first frame 2 is maintained by such overlaps as above-mentioned and coming the right-and-lower side end part of the side walls 63*a*, 63*a* of the first guide unit 63 pivotably moving into contact with the left-side end of the side walls 63*a*, 63*a* of the first guide unit 63 having finished pivotable moving. The inner-side faces of the side walls 63*a*, 63*a* at which the concavities 63*j* are formed becomes flushness.

Figure 3B:
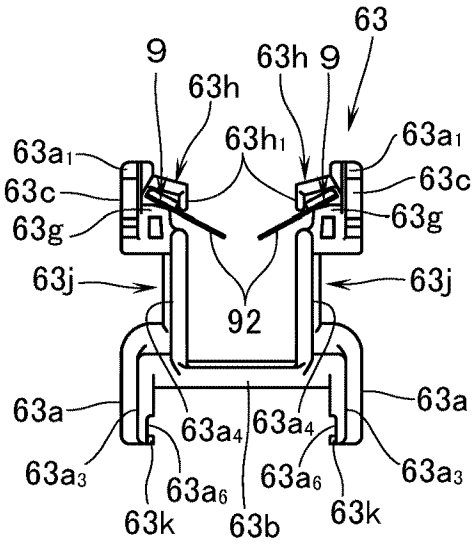
Figure 4A:
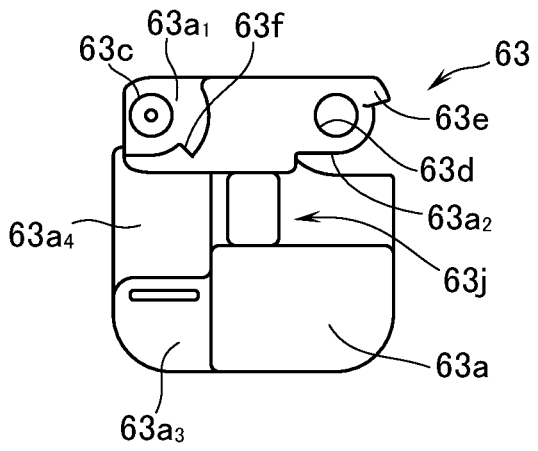
FIG. 4A, FIG. 4B, FIG. 4C and FIG. 4D are side, plan, bottom, and front views of the first guide unit shown in FIG. 2, FIG. 3A and FIG. 3B, respectively.
Figure 4B:
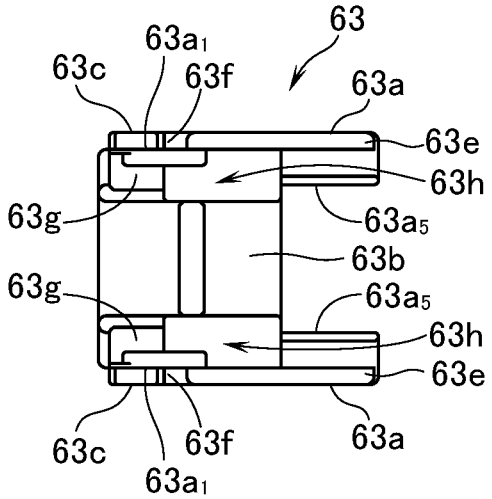
Figure 4C:
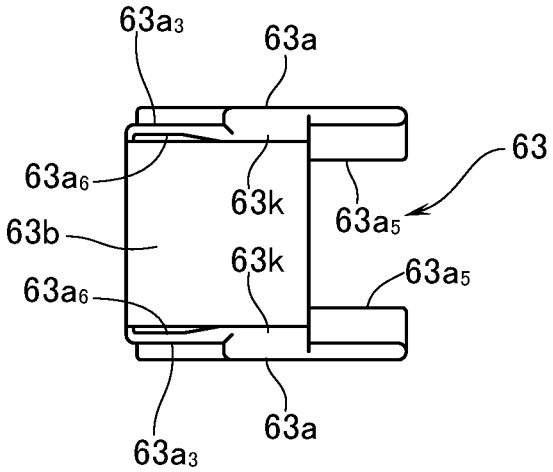
Figure 4D:
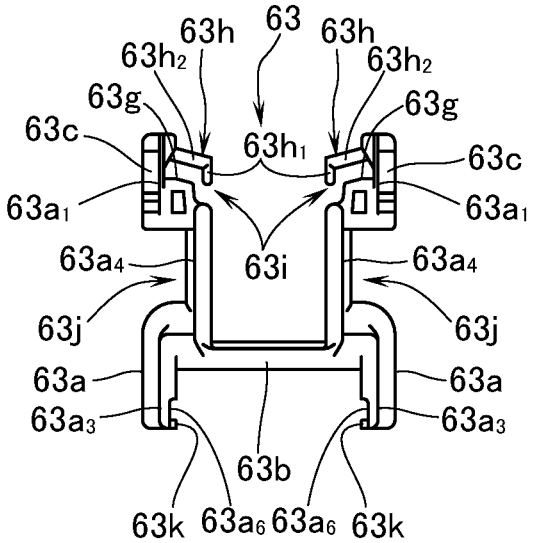

As shown in FIG. 3B, FIG. 4C and FIG. 4D, a third notch $63a_6$ is formed by cutting off each of the inner-side faces of a lower-side end part of each of the opposing second recessed parts $63a_3$. A cut-off depth of each of the third recessed parts $63a_6$ is shallow from the left-side end to the right-side end of each of the opposing second recessed parts $63a_3$. A guided piece 63*k* inwardly protruding between the opposing side walls 63*a*, 63*a* is continuously provided from a right-side end of the each of the third notches $63a_6$. A right-side end of each of the guided pieces 63*k* is positioned at a lower- and right-side end of the bottom wall 63*b*. The guided pieces 63*k*, 63*k* engage with one side end part and the other side end part in the Y-axis direction of the lower rail 5 shown in FIG. 1, respectively, when the first guide 6 is brought out of the first frame 2. Such an engagement as above-mentioned suppresses separation of each of the side guide units 63 at the brought-out portion 62 of the first guide 6. On the other hand, each of the third notches $63a_6$ smoothly releases the engagement of the each of the guided pieces 63*k* with one side end part and the other side end part in the Y-axis direction of the lower rail 5 so that separation of each of the guide unit 63 from the lower rail 5 is easy. As a result, the sliding movement of the first frame 2 in the right-and-left direction is smoothly attained.

Coming back to FIG. 1, the first guide unit 63 positioned at the right-side end of the first guide 6 is fixed to the lower-side end part of the second frame 3 and the right-side end of the first guide 6 is a fixed end. The free end 61 of the first guide 6 is always stored in the first frame 2. Specifically, the free end 61 is positioned at an upper-side end of an adjustor 10 going up-and-down along the longitudinal direction of the first frame 2. The adjustor 10 is connected with the first guide unit 63 positioned at the upper end when the first guide 6 is stored in the first frame 2. A weight 101 which is longitudinal in the perpendicular direction and has a rod-shape is built in the adjustor 101. A gravity acting the weight 101 acts a stored portion of the first guide 6 in the first frame 2. When the first frame 2 is slid in the left-side direction, the gravity assists smooth brought-out of the first guide 6 from the first frame 2 in the right-side direction against the elastic force of the coil spring 31*a* built in the roller pipe 31 and gives the closing operation of the user comfortable touch and stableness. Further, the gravity acting the weight 101 gives an appropriate resistance to storage of the first guide 6 in the first frame 2 and suppresses a rapid winding of the screen 1 around peripheral surface of roller pipe 31 by releasing the accumulated elastic force in the coil spring 31*a*.

Curved projections 11 are provided with a pair of inner-side faces, omitted in FIG. 2, opposite to each other in the Y-axis direction at the lower-side end part of the first frame 2. Each of the curved projection 11 guides storage and brought-out of the first guide 6 in the first frame 2 by being inserted into the concavities 63*j* of each of the first guide units 63. The curved projection 11 is curved at a prescribed curvature to bend the first guide 6 to smoothly direct upward in the first frame 2 and to put the first guide 6 back into the right-side direction. Accordingly, smoother storage and brought-out of the first guide 6 in and from the first frame 2 is attained.

In the above-mentioned screen device SD, when the first guide 6 is brought out of the lower-side end part of the first frame 2 according to the sliding movement of the first frame 2 in the left-side direction, the lower-side end part of the screen 1 is inserted between the opposing side walls 63, 63 of each of the first guide units 63 at the brought-out portion 62 of the first guide 6. Specifically, the lower-side end part of the screen 1 is inserted into the above-identified clearance between tips in the protruding direction of the needle-like parts 92, shown in FIG. 2 and FIG. 3A and FIG. 3B, attached to each of the opposing side walls 63*a*, 63*a* of the first guide units 63. At this time, each of the needle-like parts 92 of the screen retaining member 9 sticks a part of the screen 1 inserted into the above-identified clearance. The screen 1 is not able to slip out of the brought-out portion 62 of the first guide 6. On the other hand, the needle-like parts 92 of the screen retaining member 9 slip out of the part of the screen 1 the needle-like parts 92 has sticked when the first slide guide 6 is stored in the first frame 2 by the sliding movement in the right-side direction of the first frame 2. As mentioned above, in the screen device SD, since each of the screen retaining member 9 is detachably attached to the inner-side part of each of the opposing side walls 63*a*, 63*a* of the first guide units 63 of the first guide 6, multiple kinds of the screen retaining member 9 are prepared by mounting a plurality of the needle-like parts 92 of which a material corresponds to one of the screen 1 on the base part 91 in advance. It is possible to select an appropriate screen retaining member 9 among the ones prepared in advance and to attach an appropriate screen retaining member 9 to each of the opposing side walls 63*a*, 63*a* of the first guide units 63 of the first guide 6. Accordingly, breakages at the lower-side end part of the screen 1 are suppressed even by repletion of expansion and storage of the screen 1. Additionally, it is unnecessary to make multiple kinds of the first guide units 63 corresponding to the material of the screen 1. The slide guide 6 is formed by only one kind of the first guide unit 63.

An integrally molded article made of a rigid resin is able to be applied to the first guide unit 63. A fabric knitted by resin fibers or a net is able to be applied to the screen 1 under consideration of light weight. A soft resin or a lightweight metal, such as aluminum, is applicable to the base part 91 of the screen retaining member 9. The needle-like parts 92 is made of an appropriate material corresponding to a material of the screen 1. A size and an interval between a plurality of the needle-like parts 92 are determined for every kind of screen 1. For example, in the case of the screen 1 is a knit or net, the size of the needle-like parts 92 is one which comes in stitches or networks, and the interval is as long as one between stitches or networks and is an even interval. Further, the curve project 11 is made of a material which is hard to wear the first guide units 63 even by repetition of insertion of the curved projection 11 into the concavity 63*j*.

Figure 7:
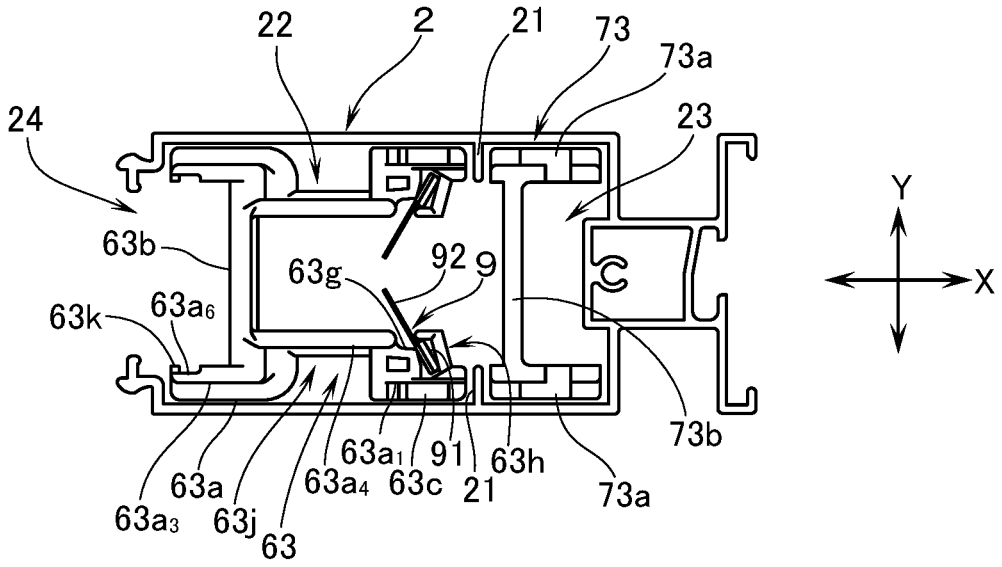
FIG. 7 is a plan view of a main part of a second guide shown in FIG. 1 and a stored condition of the first guide shown in FIG. 2 in a first frame.

Furthermore, the second guide 7 of the screen device SD is applicable to a conventional one. Similar to the first guide 6, the conventional guide is formed by connection of a plurality of second guide units 73. Referring to FIG. 7, each of the second guide units 73 is provided with a pair of side walls 73*a*, which are arranged opposite to each other in the Y-axis direction when the second guide 7 is brought out of the first frame 2, and a bottom wall 73*b* connecting the side walls 73*a*, 73*a*. In the second guide 7, among two adjacent of the second guide units 73, one second guide unit 73 is pivoted on the other second guide unit 73. An upper-side part of the expanded screen 1 is inserted between the opposing side walls 73*a*, 73*a* of each of the second guide units 73 at a brought-out portion 72 of the second guide 7 from the first frame 2. Similar to the first guide 6, a right-side end of the second guide 7 is fixed to the second frame 3 and is a fixed end.

In the screen device SD, the first and second guides 6 and 7 are stored in different areas in the inner space of the first frame 2, respectively. A pair of dividing pieces 21 extending in a longitudinal direction of the first frame 2 and protruding in the inner space of the first frame 2 is provided on a pair of inner faces opposite to each other in the Y-axis direction of the first frame 2 except upper- and lower-side end parts of the first frame 2, respectively. The inner space of the first frame 2 is divided into a first storage area 22 storing the first guide 6 and a second storage area 23 storing the second guide 7 by the dividing pieces 21. The first storage area 22 is positioned at a left-side of the inner space and the second storage area 23 at a right-side. Impinge of the first and second guides 6 and 7 is prevented by the different first and second storage areas 22 and 23 and the first and second guides 6 and 7 pass each other in the inner space of the first frame 2 and therefore, lengths of the first and second guides 6 and 7 are ones corresponding to a size in the right-and-left side direction of the opening above-identified in which the screen device DV is installed. The damage of the needle-like parts 92 of the screen retaining members 9 attached to each of the opposing side walls 63*a*, 63*a* of the first guide units 63 of the first guide 6 by the second guide 7 is prevented and there isn't any structural constraint for the second guide units 73 of the second guide 7.

Protruding tips of the dividing pieces 21, 21 are arranged in the Y-axis direction. The protruding tips of the dividing pieces 71, 71 function as a guide for going up-and-down of the guided member 12 connected with the second guide unit 73, which is positioned at the lower-side end when the second guide 7 is stored in the second storage area 23 and forms the free end 71 of the second guide 2, as well as a guide for going up-and-down of the adjustor 10 of the first guide 6. The free end 71 of the second guide 7 is positioned at a lower end of the guided member 12.

Thus, since the first and second guides 6 and 7 are stored in the first and second storage areas 22 and 23 different from each other in the inner space of the first frame 2, respectively, a width size, i.e., a size in the right-and-left side direction, of the first frame 2 is comparatively wide. Under consideration of the width size of the first frame 2, it is desirable to apply the second guide unit 73 to a unit of which a size of the perpendicular direction of each of the side walls 73*a*, 73*a* of the second guide unit 73 at a brought-out portion 72 from the second storage area 23 of the first frame 2 is shorter than that of each of the side walls 63*a*, 6]]3*a* of the first guide unit 63 at the brought-out portion 62 of the first guide 6 from the first frame 2. In the case where it is hard to attach a screen retaining member to each of the opposing side walls 73*a*, 73*a*, which is similar to the screen retaining member 9 attached to the first guide 6, a screen retaining member 13 longitudinal in the right-and-left side direction is attached to a pair of each of the inner side faces opposite to each other in the Y-direction of the upper rail 4, as shown FIG. 7. A structure of the screen retaining member 13 is similar to one of the screen retaining members 9. In this case, each of needle-like parts of the screen retaining member 13 sticks the expanded screen 1 and the slipping-out of the expanded screen 1 from the upper frame 4 is suppressed even against external forces such as the wind pressure. Breakages of an upper-side end part of the screen 1 are also suppressed even by repetition of the extraction and storage of the screen 1.

Further, in the screen device SD, a bending guide 14 bending with a prescribed curvature is arranged at an upper-side end part of the second storage area 23 of the first frame 2. The bottom wall 73*b* of each of the second guide units 73 forming the second guide 7 comes into contact with a curved face of the bending guide 14. The contact of the bottom wall 73*b* with the curved face 141 pivotably moves each of the second guide units 73 so that the second guide 7 is bent and put into the right-and-left side direction, and storage and brought-out of the second guide 7 in and from the second storage area 23 according to the sliding movement of the first frame 2 in the right-and-left-direction is smoothly attained. The prescribed curvature is appropriately determined under consideration of such the bending and returning of the second guide 7.

Furthermore, in the screen device SD, a direction changing member 15 such as a pulley are mounted on each of upper and lower end parts of the first storage area 22 of the first frame 2. Each of the direction changing members 15 is preferably pivotally supported in a block forming the upper-and-lower side end parts of the first storage area 22. The direction changing member 15 changes a direction of the tension member 8 in the perpendicular direction and gives the tension member 8 a prescribed tension by hanging the tension member 8 on a part of a peripheral surface with a curved shape.

The tension member 8 preferably forms an uncrossed loop. One end of the tension member 8 is fixed to the free end 71 of the second guide 7 by a screw. The tension member 8 directs upwardly and then changes a direction downwardly by being hanged on one direction changing member 15 positioned at the upper-side end part of the first storage area 22. The tension member is fixed to the free end 61 of the first guide 6. Further, the tension member 8 changes a direction upwardly by being hanged on the other direction changing member 15 positioned at the lower-side end of the first storage area 22 and the other end of the tension member 8 is fixed to the free end 71 of the second guide 7 together with one end above-mentioned. Storage and brought-out lengths of the first and second guides 6 and 7 in and from the first frame 2 are equal to each other by the loop-shaped tension member 8. As a result, the first frame 2 certainly slides parallel to the second frame 3 and the parallel skidding movement of the first frame 2 is achieved even though the closing operation is performed at an arbitrary part of the first frame 2 in the perpendicular direction. Similarly, the parallel siding movement of the first frame 2 is achieved at a time of the opening operation by the elastic force of the coil spring 31*a*.

When one and the other ends of the tension member 8 are fixed to the free end 71 of the second guide 7, the tension member 8 enters the second storage area 23 from the first storage part 22. The entering of the tension member 8 is allowed since the protruding ends of the dividing pieces 21, 21 is apart from each other in the Y-axis direction as shown in FIG. 7. On the other hand, as above-mentioned, the width size of the first frame 2 is comparatively long and therefore there are some cases where a fitting operation of the tension member 8 to the free end 71 is comparatively hard to be performed. In this case, a part of the guided member 12 forming the free end 71 is protruded into the first storage area 22 and one and the other ends of the tension member 8 are fixed to a such a protruded part so that the fixing operation of the tension member 8 to the free end 71 of the second guide 7 is facilitated. As shown in FIG. 7, an opening 24 communicating to the first storage area 22 is formed at a left-side end face of the first frame 2 and the tension member 8 is inserted into the inner space of the first frame 2 through the opening 24. The opening is preferably covered by a cover omitted in FIG. 7.

The invention is explained with respect to one embodiment as above-mentioned. However, the invention is not restricted to the embodiment. For example, except utilizing elastic force of the coil spring 31*a*, automatically opening and closing realized by torque of a motor at a time of expansion and storage of the screen 1 and manually opening and closing of the expansion and storage of the screen 1 are applied to the screen device SD. A foldable screen with a plurality of pleats may be applicable to the screen 1. Further, in the case where a screen device SD is manually opened and closed, the second frame 3 is not fixed to the opening above-identified, the second frame 3 in addition to the first frame 2 is slidable in the right-and-left aide direction. In this case, the screen device SD becomes a double opening screen device. Furthermore, the Z-axis direction is not limited to the vertical direction. The Z-axis direction may be at least an orthogonal direction against the X- and Y-axis directions. For example, it is possible to install the screen device SD within an opening inclined against a vertical plane.

The invention claimed is:

1. A screen device, comprising:

a screen, the screen being expandable and storable in an expanding or storing direction which is an X-axis direction in an orthogonal three-axis system that includes the X-axis, a Y-axis and a Z-axis, the screen having a first end and a second end in the X-axis direction, and the screen having a first end part and a second end part in the Z-axis direction;

a first frame and a second frame arranged opposite to each other, each of the first frame and the second frame extending longitudinally in the Z-axis direction, each of the first frame and the second frame having a first end part and a second end part in the Z-axis direction, each of the first frame and the second frame being hollow, and the first frame being a slidable frame which can slide to a first side and a second side in the X-axis direction;

a first guide and a second guide, each of the first guide and the second guide being configured to be: (i) brought out of an inner space of the slidable frame to the second side in the X-axis direction when the slidable frame slides to the second side in the X-axis direction; and (ii) stored in the slidable frame when the slidable frame slides to the first side in the X-axis direction, and each of the first guide and the second guide having a free end and a brought-out portion configured to be brought out from the inner space of the slidable frame whereby each of the first guide and the second guide maintains linearity in the X-axis direction between the first end part and the second end part in the Z-axis direction;

a tension member connecting the free end of the first guide and the free end of the second guide, the tension member being arranged in the inner space of the slidable frame; and a screen retaining member, wherein:

the first end of the screen is fixed to the first frame and the second end of the screen is fixed to the second frame;

the first guide includes first guide units connected together, each of the first guide units having: (i) side walls arranged opposite to each other in the Y-axis direction when the first guide is brought out of the inner space of the slidable frame; and (ii) a bottom wall which connects the side walls;

one of the first guide units is configured to pivot on another of the first guide units which is adjacent thereto, and the first guide is configured to maintain linearity in the X-axis direction and bend to one side in the Z-axis direction by pivoting;

the first end part of the screen in the Z-axis direction is between the side walls of each of the first guide units at the brought-out portion of the first guide;

a pin protrudes outwardly from a first end part in the X-axis direction of each of the side walls of each of the first guide units, and an opening is defined at a second end part in the X-axis direction of each of the side walls of each of the first guide units, whereby the pin of the one of the first guide units is fitted to the opening of the other of the first guide units which is adjacent thereto, such that the one of the first guide units and the other of the first guide units are connected, and each of the pins defines a pivot;

a rail part is arranged at an inner-side part of each of the side walls of each of the first guide units, the rail part extending along a line which is defined by connecting centers of the pivots of the first guide units in a connection direction of the first guide units, and a supporting piece protrudes inwardly between the side walls at an end edge part of each of the side walls, the end edge part being further from the bottom wall in the Z-axis direction than the rail part;

the screen retaining member includes needle-shaped parts attached in intervals to a longitudinal base part which is bendable in a pivotally movable direction of each of the first guide units, and the longitudinal base part is supported between the rail part and the supporting piece of each of the first guide units, and all of the needle-shaped parts protrude inwardly between the side walls of each of the first guide units; and the needle-shaped parts are configured to: (i) stick into the first end part of the screen in the Z-axis direction when the first guide is brought out to the second side in the X-axis direction according to a sliding movement of the slidable frame to the second side in the X-axis direction; and (ii) come out of the first end part of the screen in the Z-axis direction when the first guide is stored in the slidable frame according to a sliding movement of the slidable frame to the first side in the X-axis direction.

2. The screen device of claim 1, wherein:

a concavity is defined at each of the side walls of each of the first guide units and extends in the X-axis direction;

a curved projection is arranged at each of opposing inner-side faces of the first end part in the Z-axis direction of the first frame, and the curved projection is configured to be inserted into the concavity corresponding thereto of each of the first guide units; and each of the curved projections is configured to guide storing the first guide into the slidable frame and bringing the first guide out of the slidable frame.

* * * * *